US005094016A

United States Patent [19]

DiVito

[11] Patent Number: 5,094,016

[45] Date of Patent: Mar. 10, 1992

[54] FLEXIBLE SHOE POCKET

[76] Inventor: Daniel D. DiVito, 847 Miller La., Buffalo Grove, Ill. 60089

[21] Appl. No.: 602,114

[22] Filed: Oct. 23, 1990

[51] Int. Cl.[5] ..... A43B 23/00

[52] U.S. Cl. ..... 36/136; 36/1; 36/132

[58] Field of Search ..... 36/1, 132, 136; 2/245, 2/247

[56] References Cited

U.S. PATENT DOCUMENTS

| | | | |
|---|---|---|---|
| 2,662,677 | 12/1953 | Perry | 36/136 X |
| 2,871,537 | 2/1959 | Hickerson | 36/136 X |
| 4,280,287 | 7/1981 | Gulbransen | 36/136 |
| 4,296,559 | 10/1981 | Gamm | 36/136 |
| 4,384,414 | 5/1983 | Gamm | 36/132 |
| 4,507,882 | 4/1985 | Harrell | 36/136 |
| 4,536,975 | 8/1985 | Harrell | 36/136 |
| 4,630,383 | 12/1986 | Gamm | 36/136 |
| 4,638,579 | 1/1987 | Gamm | 36/136 |
| 4,823,426 | 4/1989 | Bragga | 36/136 X |

FOREIGN PATENT DOCUMENTS

| | | | |
|---|---|---|---|
| 8001750 | 9/1980 | World Int. Prop. O. | 36/132 |

*Primary Examiner*—David T. Fidei
*Assistant Examiner*—BethAnne Cicconi
*Attorney, Agent, or Firm*—Lockwood, Alex, FitzGibbon & Cummings

[57] ABSTRACT

An improved shoe pocket for carrying keys, spare change or the like on shoes includes a pocket formed between front and back faces of a sheet material. The pocket includes a flap portion which securely closes the pocket and is easily openable upon application of digital pull apart forces. The pocket is mounted to the shoe by way of two pairs of eyelets which permit the passage of a shoelace therethrough. An additional, double width eyelet in the back portion of the pocket permits the laces to continue to be threaded on the shoe side flaps and secured in a knot well above the pocket top flap without interfering therewith.

13 Claims, 1 Drawing Sheet

FLEXIBLE SHOE POCKET

BACKGROUND AND SUMMARY OF THE PRESENT INVENTION

The present invention relates generally to an accessory for shoes and, more particularly, to a flexible shoe pocket which can be securely laced to a shoe and which permits the laces to be secured over the shoe pocket.

One problem commonly encountered by participants in many physical sports, such as jogging, is what to do with keys, pocket change and the like. A sports participant can choose the obvious solution and carry his wallet or keys in a hip pocket, but the weight of the wallet or keys can often cause a slight deviation of the participant's golf swing or other sports movement. Rather than having the user carry a wallet or key chain with oneself while participating in sports, many suggestions have been made in the past to carry such articles on a sports participant's shoe. Exemplary of such suggestions are U.S. Pat. Nos. 2,662,677, 4,507,882, 4,536,975 and 4,630,383. Although all of these patents generally describe product devices which are carried on the shoe by attachment to the shoelaces, they all suffer from one or more disadvantages.

For example, although U.S. Pat. No. 2,662,677 describes a golf tee holder in the form of an open pocket secured to the golfer's shoelace, no provision is made to attach the bottom of the holder to the shoe and thus the golf tee holder continually "flaps" or bounces on the wearer's shoe while walking, swinging and putting, thereby creating a bothersome distraction. Similarly, the detachable shoe pocket described in U.S. Pat. No. 4,507,882, is also shown as being attached to the user's shoe by way of the shoelace at the pocket top only. Thus, it too will flap or bounce on the wearer's foot, creating a bothersome distraction to the proper mental state necessary for proper and complete participation in a sport.

Attempts to retain a shoe pocket at both the top and bottom of the pocket are relatively complex as shown in the shoe pocket described in U.S. Pat. No. 4,536,975. Such a shoe pocket has a pocket portion with an elongated extension of the pocket rear flap. This extension not only requires that an additional length of pocket material be rigidly secured to the pocket, but also requires a mechanical connection, such as a snap button, to correct the top and bottom portions thereof and secure the product to the shoe rather than by simply attaching to the shoelaces. Other shoe pockets, such as that described in U.S. Pat. No. 4,630,383 require that the shoe pocket be integrally formed in the shoe, particularly as an extension of the shoe tongue. Such a construction is complex and leads to increased manufacturing costs. Such a construction is not suitable for children.

The shoe pocket of the present invention provides a solution to the aforementioned problems and also provides significant advantages in that it is of relatively simple construction and allows the wearer to lace the shoelace through the pocket in a normal fashion and securely tie the same well above the upper extent of the pocket. To accomplish this, the shoe pocket of the present invention includes an elongated pocket which is preferably stitched together from a durable fabric to form a pocket which has a pocket flap that can be releaseably secured to the pocket body.

The pocket incorporates means for mounting the same to the shoe, by way of the laces thereof. A preferred mounting means includes a pair of openings or eyelets which disposed at the bottom and top portions of the pocket and are in general alignment with each other. Significantly, an additional, double-size opening or eyelet is located near to the pocket top pair of openings. This double opening permits the user to mount the pocket on the shoe well beneath the shoelace knot by threading the laces through the bottom openings and through the top openings and finally exiting through the double opening so that the shoelace knot does not interfere with access to the pocket. It further permits the wearer to wear his shoes in a "cool" fashion wherein the shoes are substantially laced yet untied.

Accordingly, it is a general object of the present invention to provide an improved pocket for a shoe for carrying keys, spare change and the like is particularly suitable for use by children and which can be easily manufactured and which permits the child to tie the shoelaces above the pocket without the lace knot interfering with access to the pocket.

Another object of the present invention is to provide a flexible pocket for an athletic shoe having a pocket flap which releaseably engages the pocket body and having means provided within the pocket body for mounting the pocket to the instep of the shoe above the shoelace thereof and further having means for permitting the laces to pass above the shoe pocket.

Still another object of the present invention is to provide an improved, colorful fabric pocket for a shoe wherein the pocket includes means for mounting the pocket to the shoelaces in place upon the instep of the shoe without the pocket bouncing, the mounting means including two pairs of eyelets passing through the pocket body portion, a pair of eyelets being disposed in the top and bottom portions of the shoe pocket and wherein the pocket further includes a double eyelet disposed in a central top portion of the shoe pocket body, which double eyelet allows the shoelace to be threaded completely through the shoe pocket and tied above the pocket without interfering therewith.

These and other objects, features and advantages of the present invention will become more readily apparent from the following detailed description taken in conjunction with the accompanying drawings wherein like reference numerals refer to like parts.

BRIEF DESCRIPTION OF THE DRAWINGS

In the course of this detailed description, reference will be made to the attached drawings in which.

DETAILED DESCRIPTION OF THE INVENTION

Figure 1:
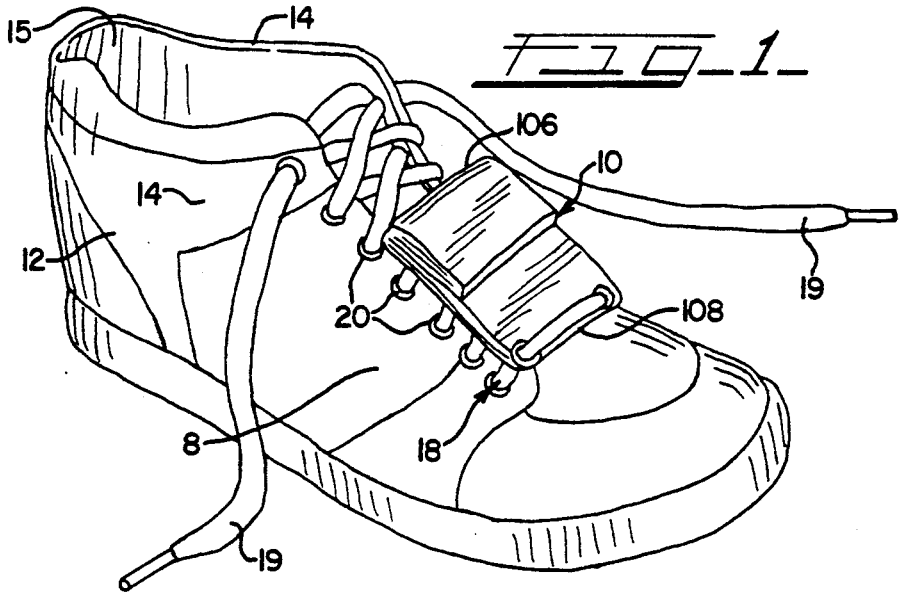
FIG. 1 is a perspective view of a flexible shoe pocket constructed in accordance with the principles of the present invention shown in place on an athletic shoe laced up but yet untied in a "cool" fashion.

A flexible shoe pocket 10 constructed in accordance with the principles of the present invention is illustrated in FIG. 1 as attached to a "high-top" athletic shoe 12 commonly used for sporting purposes. The athletic shoe 12 is conventional, having a pair of side flaps 14 which define a foot cavity 15, a shoe tongue 16 extending between the shoe side flaps 14 and means for lacing the shoe side flaps together in the form of a elongated shoelace 18 having two opposing ends 19 which are threaded through a plurality of lace eyelets 20 disposed along parallel, opposing sides of the side flaps 14. FIG. 1 is exemplary of the "cool" fashion or style of lacing "high-top" athletic shoes which fashion is currently in vogue, wherein the shoelace 18 is substantially threaded through all of the eyelets of the entire athletic shoe, but is not tied off in a knot at the ends 19 of the shoelace.

Figure 2:
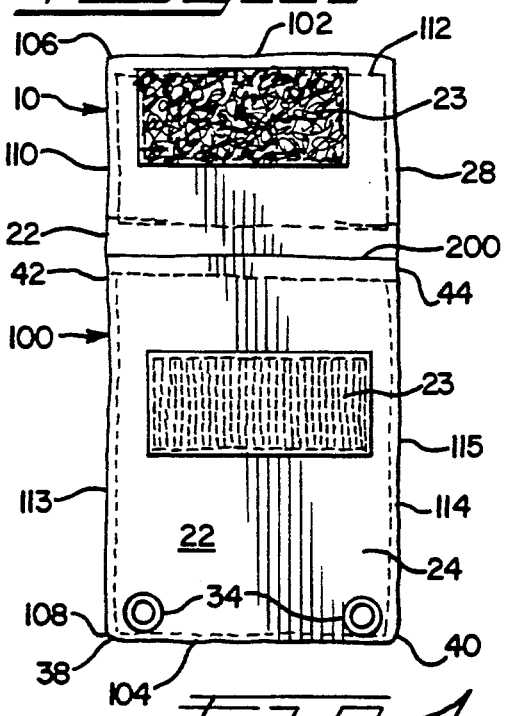
FIG. 2 is a top plan view of the shoe pocket of FIG. 1.
Figure 3:
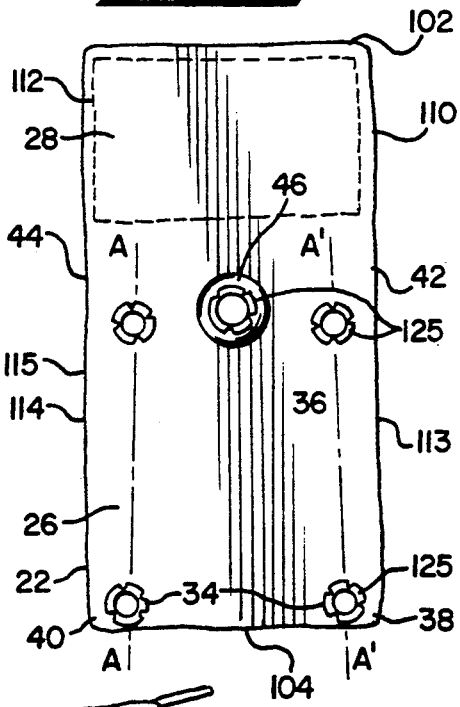
FIG. 3 is a bottom plan view of the shoe pocket of FIG. 1.

As best shown in FIGS. 2 and 3, the shoe pocket 10 has a body portion 22 which is preferably constructed from a single sheet of material 100 which includes a top cover portion 24, a bottom cover portion 26. Alternatively, the pocket can be constructed from separate top cover members and bottom cover members and securely joined together. The shoe pocket further includes an extension which serves as a top flap portion 28 and which can be folded a preselected distance over the pocket top cover portion 24. A means for securing the pocket flap 28 to the pocket cover 24 may be affixed to either the top flap or cover portion, or both as shown. A preferable securement means may be the opposing patches 23 of "Velcro" shown in the drawings, any other suitable hook and loop type fastener, snaps, buttons or even a zipper.

As mentioned above, the pocket 10 may be formed from a single sheet 100 of material, preferably a durable fabric which exhibits a preferred resistance to wear. The fabric may be of the type having a wear-resistant flexible coating applied to one surface 200 thereof, such as vinyl, latex, rubber or other similar coating to provide the pocket interior 200 with additional wear resistance. The durable fabric chosen for the pocket is preferably one having a desirable coloration, such as the currently popular fluorescent coloration or earth-tone coloration to provide added visual appeal to the pocket.

The fabric sheet 100 is elongated and is folded upon itself along two generally parallel fold lines 106, 108 so that the opposite ends 102, 104 of the fabric sheet 100 define the extent of the pocket interior 200 and the top flap portion 28. One pocket end 102 is secured along its perimeter, as by stitching 112 to form a double thickness of material and define the top pocket flap 28. In this regard, the material may be stitched together along the perimeter seams 110 running along all four sides of the top flap 28, or it may be adhesively secured by a heat sealable adhesive or any other means known in the art. Similarly, but slightly differently, the other pocket end 104 is folded along its respective fold line 108 and the overlying sheets of material are secured together, as by stitching 114 along the perimeter of its two opposing edges 113, 115 to define the pocket interior 200 therebetween.

Importantly, the pocket 10 includes means for mounting the pocket 10 to the instep 8 of the shoe 12 in the form of two pairs of openings, shown in the drawings as eyelets 34, 36, respectively. The first pair of openings 34 are preferably positioned at the lower corners 38, 40 of the pocket body portion 22 while the second pair of openings 36 are positioned proximate to the upper corners 42, 44 of the pocket body portion 22. The first and second openings may be generally aligned with each other along two vertical axes, A, $A_1$ of the shoe pocket to avoid binding of the pocket when it is in place on the shoe. The first, or bottom pair of openings 34 extend completely through the top and bottom cover portions 24, 26 of the pocket, while the second, or top pair of openings 36 extend through only the bottom cover portions 26 of the pocket body.

Figure 4:
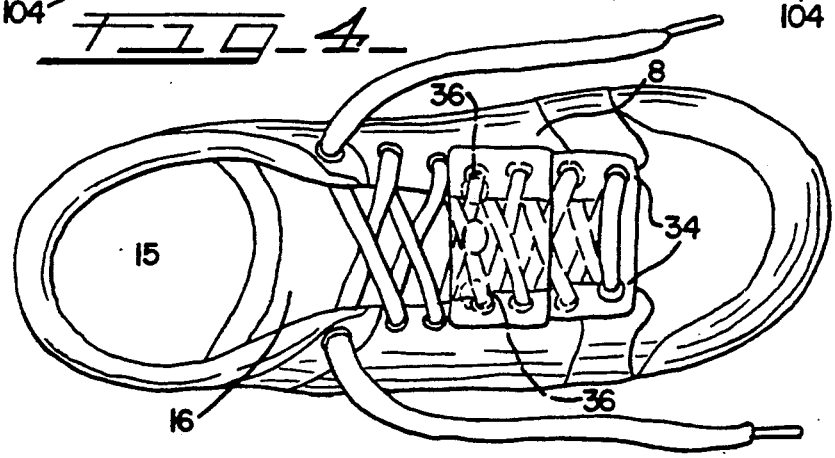
FIG. 4 is a top view of the shoe pocket in place on an athletic shoe.

In use, and as best shown in FIG. 4, the shoelace ends 19 are first threaded through the lower eyelets 34 crosswise and are further threaded crosswise through the shoe eyelets 20 located beneath the pocket 10 up to the top pair of eyelets 36. The shoelace ends 19 are then threaded crosswise through the top pair of eyelets 36, entering the pocket interior 200 and subsequently exiting the pocket interior through the central double eyelet 46. Preferably to avoid snagging the shoelace, all of the eyelets are provided with an internal smooth rim portion 125.

In an important aspect of the present invention, the double opening or enlarged eyelet 46 is provided in the general center of the bottom cover portion 26 and somewhat between the top pair of eyelets 36. This enlarged eyelet permits the shoelace ends 19 to then be further threaded back through pocket bottom cover portion 26 to the shoe eyelets 20 so that the shoelace ends 19 can be further threaded through the shoe eyelets 20 up to the top of the same and tied in a knot well above the pocket 10. Thus, the practical effect of this structure is that the user does not have to undo the shoelace ends 19 or lace knot to gain access to the contents of the pocket. Furthermore, such a structure does not require the shoelace ends 19 to be tied at all, allowing the user to use the pocket with "cool" fashions such as shown in FIG. 1.

Thus, it will be appreciated that the shoelaces need not be untied for access to the present invention, but must be positively removed from the laces to remove the pocket from the shoe, thereby ensuring the security of the same and avoiding the loss of the pocket and its contents. Moreover, the presence of the double opening or eyelet 46 permits the user to wear the pocket 10 on a shoe in the "cool" fashion shown in FIG. 1 without fear of loss of the pocket and its contents. Furthermore, because both the top and bottom portions of the pocket 10 are held against the user's instep, the pocket will not flap or bounce around to create a distraction to or annoy the user.

I claim:

1. A flexible pocket for attachment to a shoe having a tongue, the pocket having means formed within a body portion of the pocket for mounting said pocket on the shoe and for preventing the displacement of said pocket when installed on said shoe overlying the tongue, comprising: a pocket body portion having a top cover member and a rear cover member, the top cover member being attached to the rear cover member around three sides of said top and rear cover members to define a pocket therebetween adapted to carry money, keys or the like, the flexible pocket further including a top flap portion which is foldable around a transverse fold line of said pocket and which closes said pocket, the top flap portion being an integral extension of said pocket rear cover member, said pocket including means for closing said pocket by securing said pocket top flap member to said top cover member in a closed position, said pocket closing means being releasable upon application of digital forces to said pocket top flap member, said pocket body portion further including means for mounting said pocket on an instep portion of the shoe and above said tongue of the shoe in a manner where the pocket does not displace itself, said mounting means including a first pair of pocket openings adapted to receive the passage of two shoelace ends therethrough, the first pair of openings being disposed along a first edge of said pocket body portion, said first pair of openings passing completely through said top and rear cover members, a second pair of pocket openings also adapted to receive the passage of two shoelace ends therethrough, the second pair of openings disposed on said pocket body portion in general alignment with said first pair of openings, said second pair of openings passing through said rear cover member, said second pair of openings passing through said rear cover member and not passing through said top cover member, and a third, enlarged opening adapted to receive the passage of said two shoelace ends therethrough, the third opening being disposed in said pocket body portion rear cover member proximate to and in alignment with said pair of second openings, said pocket third opening passing through said back cover member, said third opening being sized to receive the passage of two shoelace ends therethrough simultaneously, whereby said third opening permits two shoelace ends of said shoe to exit said pocket and pass underneath said pocket so as to permit said two shoelace ends to be threaded into shoe eyelets disposed above said pocket so that said two shoelace ends can be tied together above said pocket, said first, second and third openings including eyelet members having smooth interior rim portions.

2. The flexible pocket of claim 1, wherein said pocket is formed from a single, elongated sheet of a durable fabric, the single elongated sheet being folded upon itself along a second and third transverse fold line of said pocket.

3. The flexible pocket of claim 1, wherein said pocket is formed from a durable fabric, the durable fabric having a wear-resistant coating applied to one side of said durable fabric such that the wear-resistant coating forms an inner surface of said pocket.

4. The flexible pocket of claim 1, wherein said pocket closing means includes two opposing strips of hook and loop fastening material disposed on an inner surface of said pocket flap portion and an outer surface of said pocket top cover portion.

5. The flexible pocket of claim 1, wherein said pocket is formed from a durable fabric and the durable fabric has a distinctive fluorescent coloration.

6. The flexible pocket of claim 1, wherein said pocket is formed from a durable fabric and the durable fabric has an earth-tone coloration.

7. An improved accessory pocket for a shoe having an elongated tongue portion which extends longitudinally between two shoe side flaps, the shoe side flaps each having a row of shoe eyelets extending along an edge of the side flap, the shoe having a shoelace with two opposing ends extending through the shoe eyelets in a crosswise fashion, the accessory pocket comprising:

a pocket body portion formed from a generally elongated, single sheet of material, a first portion of said sheet being folded upon an underlying portion of itself around a first transverse fold line of said product, said first portion and the underlying portion of said sheet being attached together at three sides to define a pocket having an open mouth portion, said first portion defining a cover portion of said accessory pocket, part of said underlying portion defining a back portion of said accessory pocket, said underlying portion further including an extension portion folded upon itself around a second transverse fold line to define a pocket top flap of said accessory pocket, the pocket top flap being foldable around a third transverse fold line of said accessory pocket, an inner surface of said pocket top flap which opposes an outer surface of said pocket cover portion, means for releasably securing said pocket top flap to said cover portion, said accessory pocket including means for mounting said accessory pocket to an instep portion of said shoe wherein said accessory pocket threadedly engages said shoelace and is disposed above said shoelace in an overlying relationship therewith, mounting means including first and second pairs of eyelets, the first pair of eyelets being disposed along a lower edge of said pocket body portion, said first pair of eyelets passing completely through said pocket cover and back portions, each eyelet of said first pair of eyelets being adapted to allow the passage of a shoelace opposing end therethrough such that said shoelace opposing ends can be threaded through said shoe eyelets underneath said accessory pocket, the second pair of eyelets being disposed in said pocket back portion above said first pair of eyelets and in general alignment therewith, said second pair of eyelets passing through said pocket back portion and not said pocket cover portion, each eyelet of said second pair of eyelets also being adapted to allow the passage of a shoelace opposing end therethrough, thereby defining an entrance passage in said pocket back portion to allow the user of said accessory shoe pocket to thread said shoelace opposing ends into said pocket, the accessory pocket mounting means further including a third, enlarged eyelet in said pocket back portion, the third eyelet being disposed in said pocket back portion generally between said second pair of eyelets, said third eyelet being adapted to allow the passage of said shoelace two opposing ends therethrough, thereby defining an exit passage in said pocket back portion which permits the user of said accessory shoe pocket to thread said shoe opposing ends out of and underneath said pocket and into further engagement with said shoe eyelets, thereby permitting said accessory shoe pocket to be worn on said shoe beneath a knot tied in said shoelace ends, each of said first and second pairs of eyelets and said third, enlarged eyelet including an interior, generally smooth rim portion, said third eyelet being laterally aligned with said second pair of eyelets to permit the exiting passage of said shoelace opposing ends from said pocket and tied together above said pocket without said pocket displacing on said shoe.

8. The accessory shoe pocket of claim 7, wherein said shoe pocket single sheet of material is a durable fabric.

9. The accessory shoe pocket of claim 8, wherein said durable fabric has a wear-resistant coating applied to interior surfaces of said pocket.

10. The accessory shoe pocket of claim 8, wherein said durable fabric has a distinctive coloration.

11. The accessory shoe pocket of claim 10, wherein said durable fabric distinctive coloration is a fluorescent coloration.

12. The accessory shoe pocket of claim 9, wherein said durable fabric distinctive coloration is an earth-tone coloration.

13. The accessory shoe pocket of claim 6, wherein each of said first and second pairs of eyelets and said third, enlarged eyelet include an interior, generally smooth rim portion.

* * * * *